US006395211B1

(12) United States Patent
Dettmer et al.

(10) Patent No.: US 6,395,211 B1
(45) Date of Patent: May 28, 2002

(54) METHOD AND CALENDER FOR TREATING A SHEET

(75) Inventors: Klaus Dettmer; Achim Wandke; Vladimir Tocaj, all of Krefeld (DE)

(73) Assignee: Eduard Kusters Maschinenfabrik GmbH & Co. KG, Krefeld (DE)

( * ) Notice: Subject to any disclaimer, the term of this patent is extended or adjusted under 35 U.S.C. 154(b) by 0 days.

(21) Appl. No.: 09/554,550

(22) PCT Filed: Oct. 8, 1998

(86) PCT No.: PCT/EP98/06390

§ 371 (c)(1),
(2), (4) Date: Jun. 21, 2000

(87) PCT Pub. No.: WO99/25911

PCT Pub. Date: May 27, 1999

(30) Foreign Application Priority Data

Nov. 14, 1997 (DE) ..... 297 20 192 U

(51) Int. Cl.[7] ..... B29C 67/00; B29C 71/00; B30B 3/04; B30B 15/34

(52) U.S. Cl. ..... 264/156; 100/155 R; 100/163 R; 100/327; 100/331; 264/280; 264/284; 264/348; 425/363; 425/369; 425/446; 425/290

(58) Field of Search ..... 264/154, 155, 264/156, 163, 280, 284, 348; 425/363, 369, 446, 290; 100/155 R, 163 R, 327, 331

(56) References Cited

U.S. PATENT DOCUMENTS

| | | | | |
|---|---|---|---|---|
| 3,478,141 A | | 11/1969 | Dempsey et al. | |
| 3,912,567 A | | 10/1975 | Schwartz | |
| 4,886,632 A | * | 12/1989 | Van Iten et al. | 264/156 |
| 5,626,571 A | | 5/1997 | Young et al. | |

FOREIGN PATENT DOCUMENTS

| | | |
|---|---|---|
| DE | 1 808 286 | 8/1969 |
| DE | 34 16 004 A1 | 10/1985 |
| DE | 39 36 128 A1 | 5/1991 |
| DE | 38 04 611 C2 | 1/1992 |
| DE | 195 20 479 A1 | 1/1996 |
| GB | 2 285 066 A | 6/1995 |
| WO | 98/07907 A1 | 2/1998 |

* cited by examiner

*Primary Examiner*—Leo B. Tentoni
(74) *Attorney, Agent, or Firm*—Kenyon & Kenyon

(57) ABSTRACT

A calender for treatment of a web of a nonwoven textile V made of thermoplastic fibers. The calendar includes a heated embossing roller made of steel and a counter-roller that runs at the same circumference velocity. The local plastification in the nonwoven textile V that is produced at the locations of the raised embossing areas results in a board-like feel of the nonwoven textile V. To reduce this hardness, the web of the nonwoven textile V is broken, after having cooled at least partially.

6 Claims, 1 Drawing Sheet

METHOD AND CALENDER FOR TREATING A SHEET

FIELD OF THE INVENTION

The present invention relates to a method and apparatus for treating a nonwoven web of thermoplastic fibers.

BACKGROUND OF THE INVENTION

As used herein, the term "treatment" includes everything that can be achieved with local plastification and/or melting of a nonwoven textile of thermoplastic fibers that accompanies the effect of hot raised embossing. In other words, treatment refers in particular to thermal bonding of the nonwoven due to local adhesion of the fibers (as discussed in German Patent OS 1 808 286 and U.S. Pat. No. 3,478, 141). Treatment also refers to formation of perforations, with melting of the fiber zone located below a raised embossing area, and displacement of the melted mass. A suitable calender for performing this operation is disclosed in German Patent 34 16 004 A1.

In that patent, an embossing roller made of steel and a smooth counter-roller made of steel rotate at the same circumference velocity and form a roller pair. A nonwoven textile made of thermoplastic fibers is guided through the roller pair. The raised parts of the embossing roller rest against the counter-roller with their faces. Because they are heated, the raised areas partially or completely melt the parts of the nonwoven textile that are held between the rollers, and bond the nonwoven by bonding the fibers, or displace the melted mass to the edge of the face of the embossing surface. At the edge of the face, the melted thermoplastic material solidifies and forms bonding zones that edge the holes formed by the displacement, and, at the same time, stabilize the nonwoven.

After leaving the roller nip, the web of the nonwoven textile is rather stiff and board-like, because of the many regions of compact material that have melted together.

WO 98/07907 discloses mechanically softening a nonwoven structure produced by "flash spinning." However, no information, in detail, is provided as to how to do this.

The present invention is based on the object of developing the described process so that a nonwoven textile made of thermoplastic fibers and "treated" in the manner described has a softer feel. A softer feel is desirable in many situations.

In accordance with that object, a web is passed through a roller nip between an embossing roller and a counter-roller. This causes local plastification—i.e. melting—in the nonwoven at the locations of raised embossing areas on the embossing roller. The areas of plastification in the nonwoven that have solidified after leaving the roller nip are broken.

By breaking them, the rigid regions that are formed by local plastification of the thermoplastic material are broken down. This significantly reduces the hard feel of the nonwoven textile.

In accordance with another aspect of the present invention, the nonwoven web can be positively cooled after leaving the roller nip and before being broken. This makes the thermoplastic material of the nonwoven textile more brittle and the breaking effect more accessible.

As used herein, "positive" cooling is cooling brought about by a cooling device in contrast to cooling that results from merely giving off heat into the surroundings.

A calender for use in the present invention has a rotating, heated embossing roller made of steel. A counter-roller acts together with the embossing roller. Means for passing the web through a roller nip formed between the embossing roller and the counter-roller is provided.

Also provided are means for pressing the embossing roller and the counter-roller together, in such a way that the embossing in the web produces local plastification in the nonwoven at the locations of raised embossing areas as the nonwoven passes through the roller nip.

Following the roller nip is a device for breaking the areas of plastification that have solidified after leaving the roller nip.

In first embodiment of a breaking device, a third roller is provided. The third roller forms a three roller calendar, and is unheated or positively cooled.

The advantage of the third toller is that the two rollers of the calender and the breaking unit are integrated into a single assembly.

A particularly advantageous embodiment has three rollers aligned in one plane. The outer two rollers are deflection-controlled rollers and hold the middle roller between them. This arrangement allows uniformity of treatment of the nonwoven textile in the roller nip over the width of the web. In this embodiment, the web is cooled on the looping path of the non-heated or actually cooled counter-roller.

In a further development of the device, a device for positive cooling of the treated nonwoven web before breaking is provided.

It has proven to be practical if the web is thermally bonded before passing through the calender so that the fibers of the nonwoven are no longer loose, but rather grouped in a geometrically defined structure before they run into the roller nip. This prevents the undesirable adhesion of individual fibers to the hot embossing roller and an accumulation of thermoplastic material on the roller.

BRIEF DESCRIPTION OF THE DRAWINGS

Exemplary embodiments of the invention are shown in the drawing, in schematic form.

DETAILED DESCRIPTION

Figure 1:
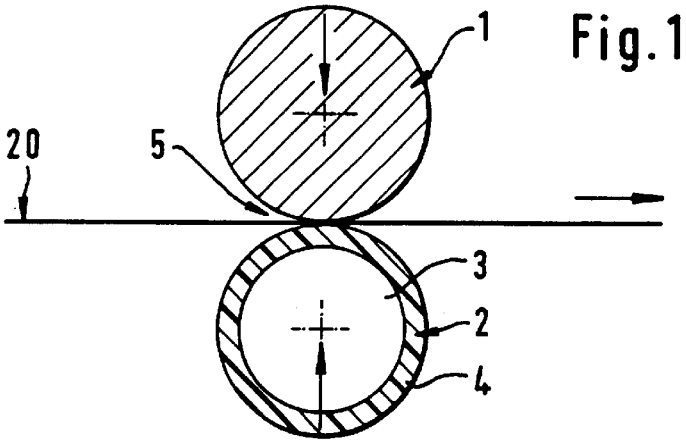
FIG. 1 shows a side view of a calender for implementing a treatment in accordance with the invention.
Figure 2:
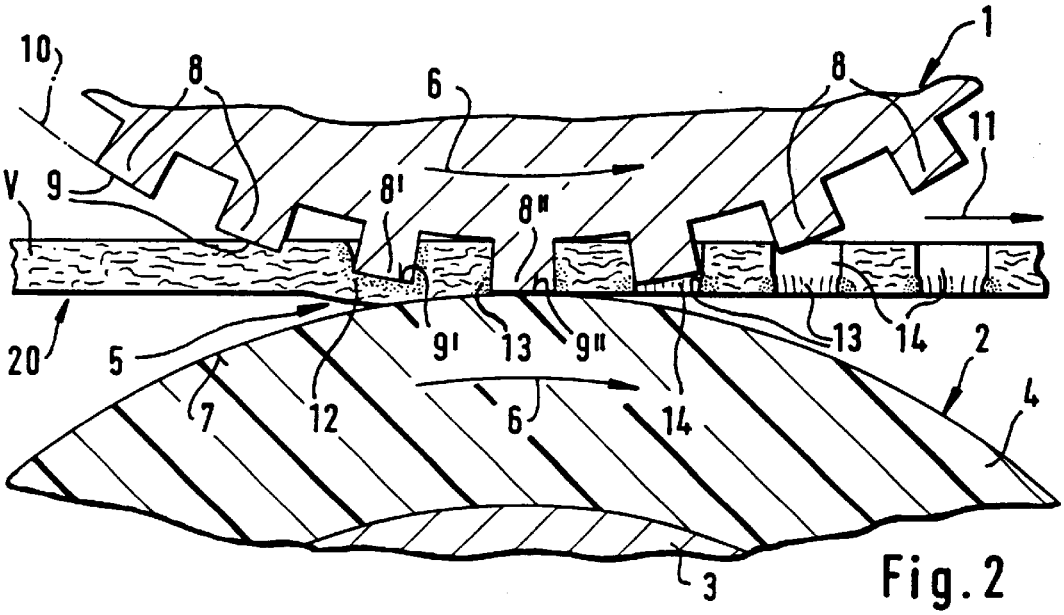
FIG. 2 shows a side view of the roller nip of the calender of FIG. 1, on a larger scale.

FIGS. 1 and 2 represent a special example of a calender in which the treatment performed on a web 20 of a nonwoven textile 20 is perforation.

The calender shown in FIG. 1 includes an embossing roller 1 made of steel and a counter-roller 2. The counter-roller has a hard plastic coating 4, with a Shore D hardness of 90, for example, on a cylindrical roller body 3. The rollers 1, 2 form a roller nip 5 between them. A pre-bonded web 20 of a nonwoven textile V made of thermoplastic fibers is introduced into the nip 5. A uniform linear pressure over the width of the web in the roller nip 5 is very important. Thus, at least one of the two rollers 1, 2 is a deflection-controlled roller. The rollers 1, 2 are mounted in a machine frame at their ends, and are pressed against one another in the direction of the arrow.

The rollers 1, 2, rotate in the direction of the arrows 6, at the same circumference velocity, and touch one another in the roller nip 5. The plastic coating 4 of the counter-roller 2 has a smooth cylindrical surface 7. The embossing roller 1 has raised embossing areas 8 uniformly distributed over its entire surface in accordance with a pattern. The outer faces 9 of the embossing areas 8 are located in a cylinder surface 10. In the exemplary embodiment, the raised embossing areas 8 have a diamond-shaped cross-section, viewed in a tangential plane of cylinder surface 10, and the greatest dimension of the cross-section is only a few millimeters, e.g. 2 mm. The clear areas between individual raised embossing areas 8 are of the same magnitude.

Nonwoven textile V is pre-bonded, so that the fibers are held together and do not come into contact with the surface of the embossing roller 1, which is heated to 220° C., prematurely and individually. As the rollers 1, 2 rotate in the direction of arrows 6, and as the nonwoven textile V moves forward in the direction of the arrow 11, the nonwoven textile V is compressed between the face of the raised embossing area 8' and the circumference 7 of the roller 2. Heat is transferred from the raised embossing area 8' into the nonwoven textile V, causing it to plastify and start to melt in the region of the raised embossing area 8', as indicated in FIG. 2 by reproduction of the corresponding cross-section areas with a broken line. In this connection, the heat does not flow out of the region of the nonwoven textile V that lies in front of the face 9' of the raised embossing area 8', into the plastic coating 4, in any large amounts, because the latter has a low heat conductivity and significant heat transport is not possible during the short period of time available.

The raised embossing area 8" has already reached the narrowest part of the roller nip 5 and practically rests against the outside circumference 7 of the plastic coating 4 with its face 9". The melted material of the zone 12 has been displaced by the pressure of the raised embossing area 8", between its face 9" and outside the circumference 7 of the plastic coating 4, and forms a compact ring 13 in the material of the nonwoven textile V, surrounding raised embossing area 8". No nonwoven material remains between the face 9" and the circumference surface 7, so that a perforation hole 14 is formed there, surrounded by compact ring 13. The material does not flow together again but rather leaves the perforation hole free when the raised embossing areas 8 move out of the perforation holes 14 that have been formed, as shown on the right side of FIG. 2.

The compacted ring 13, in each instance, is a rigid surface element that gives the nonwoven textile V a board-like feel, i.e. a hard feel, after it has cooled down below the plastification range of the thermoplastic material. This feel is undesirable in many situations.

Figure 3:
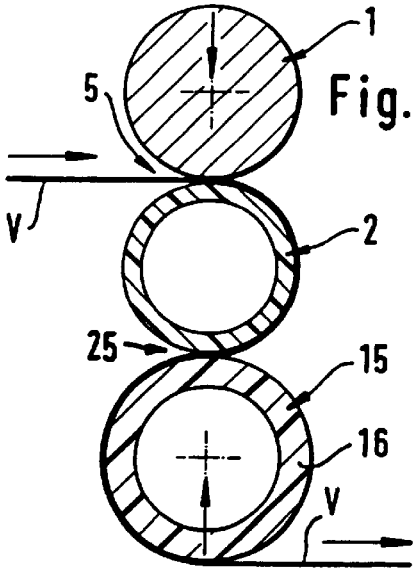
FIG. 3 shows a view, corresponding to FIG. 1, of a calender that implements the invention, expanded to include a breaking roller.

In order to counteract this, in FIG. 3 the roller pair of FIG. 1 is supplemented with a breaker roller 15. The breaker roller has a plastic coating 16 with a Shore D hardness of less than 60, for example, and rests against the counter-roller 2 on the side opposite the embossing roller 1. The breaker roller breaks the nonwoven textile that was perforated in the roller nip 5, in order to break up the rings 13 of displaced melted material that surround the perforation holes 14. This makes the rigid zones within the nonwoven textile smaller in size, and reduces the hard feel of the nonwoven textile that exists after it leaves the roller nip 5. Breaking takes place in the roller nip 25, after the web 20 of nonwoven textile has been cooled sufficiently on its path around the unheated counter-roller 2. The rollers 1 and 15 are deflection-controlled, as indicated by the arrows, and hold the counter-roller 2 between them. In this way, the treatment effect is particularly uniform over the width of the web.

Figure 4:
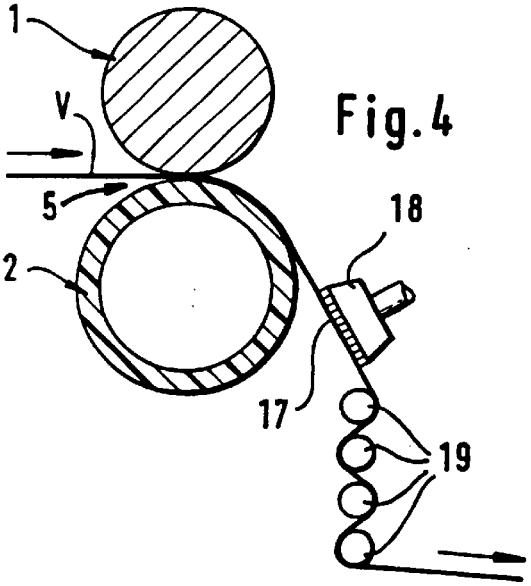
FIG. 4 shows a corresponding view of a calender with another breaking device.

FIG. 4 shows an embodiment in which a cooling segment 17 follows the roller pair 1, 2, and the breaking device is structured separately. Cooling air is blown onto the nonwoven textile V from a nozzle device 18 after it leaves the roller nip 5, in order to significantly reduce the plasticity in the nonwoven textile of the rings 13 that have been formed around the perforations 14. The web of nonwoven textile V subsequently passes through a set of four diverting rollers 19 with a small diameter. The diverting rollers are parallel to one another, run perpendicular to the web, and follow one another at a slight distance in the direction of movement of the nonwoven textile V. In the exemplary embodiment, the diverting rollers are arranged in a plane and the nonwoven textile V is passed in a zigzag pattern over them, so that a breaking effect is achieved by the back and forth movement.

What is claimed is:

1. A process for treatment of a web of a nonwoven textile made of thermoplastic fibers by a rotating, heated embossing roller made of steel and a counter-roller that acts together with the embossing roller, comprising the steps of:

passing the web through a roller nip formed between the embossing roller and the counter-roller;

causing local plastification in the nonwoven textile at the location of raised embossing areas located on the embossing roller;

positively cooling the areas of plastification to create solidified areas of plastification; and breaking the solidified areas of plastification.

2. A calender for treatment of a web of a nonwoven textile made of thermoplastic fibers comprising:

a rotating, heated embossing roller made of steel;

a counter-roller that acts together with the embossing roller;

means for passing the web through a roller nip formed between the embossing roller and the counter-roller;

means for pressing the embossing roller and the counter-roller together so that the embossing in the web produces local plastification in the nonwoven textile at the locations of raised embossing areas as the nonwoven textile passes through the roller nip;

a device for positively cooling the web located after the roller nip; and a device for breaking the areas of plastification that have solidified after leaving the roller nip following the roller nip.

3. The calender according to claim 2, further comprising:

a third roller that forms a three-roller calender together with the embossing and counter-rollers, wherein the third roller is unheated or actually cooled.

4. The calender according to claim 3, wherein the three rollers lie in one plane with their axes, and the embossing and third rollers are deflection-controlled rollers that hold the counter-roller between them.

5. The calender according to claim 2, further comprising diverting rollers that are arranged parallel to one another, perpendicular to the web, and follow one another closely, with the web being passed around them in zigzag shape.

6. The calender according to claim 2, further comprising a device for pre-bonding the web of the nonwoven material located before the roller pair.

* * * * *